US008038741B2

(12) United States Patent
Awang et al.

(10) Patent No.: US 8,038,741 B2
(45) Date of Patent: Oct. 18, 2011

(54) FUEL COMPOSITION

(75) Inventors: Roila Awang, Selangor (MY); Choo Yuen May, Selangor (MY)

(73) Assignee: Malaysian Palm Oil Board, Selangor (MY)

( * ) Notice: Subject to any disclaimer, the term of this patent is extended or adjusted under 35 U.S.C. 154(b) by 590 days.

(21) Appl. No.: 12/118,896

(22) Filed: May 12, 2008

(65) Prior Publication Data

US 2008/0282604 A1 Nov. 20, 2008

(30) Foreign Application Priority Data

May 15, 2007 (MY) ..... PI 20070757

(51) Int. Cl.
*C10L 1/18* (2006.01)

(52) U.S. Cl. ..... 44/301; 44/302; 44/443

(58) Field of Classification Search ..... 44/301, 44/443, 302
See application file for complete search history.

(56) References Cited

U.S. PATENT DOCUMENTS

| | | | | |
|---|---|---|---|---|
| 2004/0098904 | A1* | 5/2004 | Steinmann | 44/302 |
| 2005/0060928 | A1 | 3/2005 | Oldfield et al. | |
| 2010/0037513 | A1* | 2/2010 | Petrucci et al. | 44/301 |

OTHER PUBLICATIONS

Evaluation of biodiesels from several oilseed sources as environmental friendly contact herbicides; Vaughn et al, Industrial Crops and Products 26 (Jan. 2007),pp. 63-68.*

* cited by examiner

*Primary Examiner* — Cephia D Toomer
(74) *Attorney, Agent, or Firm* — Preston Smirman; Smirman IP Law, PLLC

(57) ABSTRACT

A fuel composition comprising a water-in-oil phase emulsion comprises bio-diesel; water; and at least one type of polymeric surfactant.

7 Claims, No Drawings

FUEL COMPOSITION

RELATED APPLICATIONS

The present application is based on, and claims priority from, Malaysian Patent Application Number PI 20070757, filed May 15, 2007, the disclosure of which is hereby incorporated by reference herein in its entirety.

FIELD OF THE INVENTION

The present invention relates to a fuel composition which can greatly reduce emission of nitrogen oxides when being used for power generation in an engine. More specifically, the disclosed fuel composition is actually prepared in an emulsion form for using in an engine.

BACKGROUND OF THE INVENTION

Bio-diesel is a diesel replacement fuel that is manufactured from vegetable oils, recycled cooking greases or oils, or animal fats. Numerous studies have shown that most exhaust emissions encountered with conventional diesel fuel are reduced with bio-diesel, with the exception of nitrogen oxide emission. In fact, some of the conducted research shows an increase of nitrogen oxide emission by about 10% to 13% in bio-diesel used as compared to petrol diesel. In order to reduce the nitrogen oxide emission from the bio-diesel combustion, modification of the engine combustion chamber and post-exhaust treatment installation are applicable techniques. Alternatively, the reduction of nitrogen oxide emission can be achieved by using an improved fuel composition. The improved fuel composition may contain additives to attain the desired object.

U.S. Patent Publication No. 20050060928, disclosed a fuel composition comprising an emulsion of bio-diesel and alkoxylated alcohol as well as alkoxylated fatty acid with the aid of alkanolamide. In this U.S. application, the fuel composition is only constituted of low amounts of bio-diesel while other component of the fuel composition derives from the surfactant mixture.

SUMMARY OF THE INVENTION

The present invention aims to provide an improved fuel composition to be used in power generation by combusting it in an engine combustion chamber.

Further objects of the present invention is to disclose an improved fuel composition which is capable of releasing reduced amounts of nitrogen oxide while being used in an engine for producing energy.

Still another object of the disclosed invention is to provide a cost-effective fuel composition which can be used for power generation yet emit less nitrogen oxide during combustion.

At least one of the preceding objects is met, in whole or in part, by the present invention, in which one of the embodiments of the present invention includes an emulsion fuel comprising biodiesel, water and surfactant. The preferred surfactant is a polymeric surfactant.

According to the preferred embodiment of the present invention, the polymeric surfactant has a chemical structure of $$R'—O—(CH_2CH_2—O—)_x—R'$$

wherein R' is an alkyl radical containing hydroxyl group and x is a positive integer ranges from 14 to 50. The preferred polymeric surfactant for use in the present invention includes PEG 1500 dihydroxystearate.

Preferably the bio-diesel has a concentration of 70% to 98%, the water has a concentration of 2% to 30%, and the polymeric surfactant has a concentration of 0.1% to 5% by total weight of the disclosed fuel composition.

Moreover, other additives such as corrosion inhibitors, antifreeze agents, ash modifiers and soot release agents can be added into the disclosed composition to enhance its performance in engines.

DETAILED DESCRIPTION OF THE INVENTION

It is to be understood that the present invention may be embodied in other specific forms and is not limited to the sole embodiment described herein. However, modification and equivalents of the disclosed concepts such as those which readily occur to one skilled in the art are intended to be included within the scope of the claims which are appended thereto.

The present invention is a fuel composition comprising a water-in-oil phase emulsion comprising bio-diesel, water, and at least one type of polymeric surfactant. The disclosed fuel composition is capable of emitting low amounts of nitrogen oxide while being combusted in the engine in comparison to petrol bio-diesel. The fuel composition in the present invention is prepared by forming an emulsion of bio-diesel and water thus leading to a lowered peak flame temperature yet providing satisfying power during combustion in the engine. Consequently, the emission of nitrogen oxide is reduced greatly. Preferably, the amount or concentration of the bio-diesel in the disclosed fuel composition is within the range of 70% to 98% by total weight of the fuel composition. Moreover, the bio-diesel is derived, but not limited to, from the source of oil palm, soybean oil, coconut oil, groundnut oil, safflower oil, linseed oil, corn oil, sunflower oil, olive oil, canola oil, cottonseed oil, rapeseed oil, tang oil and derivatives thereof such as fractional portions. Nevertheless, it is possible also that the bio-diesel derives from recycled sources like cooking grease, oil or animal fats. It is important to be noted that the emulsion form taken by the disclosed composition preferably has water as the dispersed phase and bio-diesel as the continuous phase. In another preferred embodiment, the concentration of water in the fuel composition ranges from 2% to 30% by total weight of the fuel composition. The amount of water and bio-diesel in the disclosed composition can be varied depending upon the types of bio-diesel employed. It is know in the art that hydrocarbon chains for bio-diesel from different source are varied. Thus, it is an interest of the present invention to adjust the proportion of the water and bio-diesel content in the disclosed composition to bring out the desired properties.

In respect to the preferred embodiment, at least one type of surfactants are added into the fuel composition to stabilize the formed emulsion. For the prepared emulsion to combust completely without leaving any solid residues in the engine or wearing the combustion chamber of the engine, it is crucial to employ the correct surfactants in preparing the fuel composition. One of the preferred embodiments of the present invention involves using polymeric surfactants in preparing the fuel composition. Representations of polymeric surfactants can be incorporated into the fuel composition are those derived from the group of polyethylene glycol esters, in particular PEG1500dihydroxystearate. Nonetheless, it is preferred that the surfactants are prepared from natural or sustainable sources. For example, the surfactants may be prepared by condensation of hydroxyl fatty acids and polyol compounds derived from vegetable oil or animal fat. In the most preferable embodiment, the polymeric surfactant comprises a basic chemical structure of $$R'—O—(CH_2CH_2—O—)_x—R'$$

wherein R' is an alkyl radical containing a hydroxyl group and x is a positive integer ranging from 14 to 50. One skilled in the art shall appreciate the fact that any modification from this chemical structure in preparing the fuel composition shall not depart from the scope of the present invention. Reliance upon the types of polymeric surfactants and amounts of other components, the concentration of the surfactants can range from 0.1% to 5% by total weight of the fuel composition.

Besides this, another embodiment of the fuel composition may further incorporate additives such as corrosion inhibitors, antifreeze agents, ash modifiers, soot releasing agents or any combination derived thereof. The representation of the antifreeze agent is any one or combination of methanol, ethanol and ethylene glycol.

It is important to note, the disclosed fuel composition in the present invention can be acquired via different well described methods know in the art, which especially involves applying adequate shearing force, heat or even pressure in preparing an emulsion from a mixture containing the set forth components. Therefore, such modification in preparing the disclosed composition shall not depart from the scope of the present invention.

The following example is intended to further illustrate the invention, without any intent for the invention to be limited to the specific embodiments described therein.

EXAMPLE 1

Emulsions were prepared by mixing a bio-diesel and water using a homogenizer in the presence of a polymeric surfactant/emulsifier as a stabilizer. About 80% by weight of bio-diesel containing 2 to 5% emulsifier was pre-heated at 50° C. with continuous stirring. Required amounts of water were then added into the oil/fuel phase and mixed using the homogenizer for 2 to 10 minutes at the adjusted speed of 2000 to 5000 rpm. After this time, the emulsion, X, was cooled to room temperature before storage.

About 95% by weight of bio-diesel containing 2% to 5% emulsifier was pre-heated at 50° C. with continuous stirring. Required amounts of water were then added into the oil/fuel phase and mixed using a hand-held low speed mixer for 2 to 10 minutes at 200 to 1300 rpm. After this time, the emulsion, Y, obtained was cooled to room temperature for storage.

Table 1 and 2 show the properties and nitrogen oxide emissions of palm bio-diesel, emulsion X and emulsion Y.

TABLE 1

| Properties | Palm Bio-diesel | X | Y |
|---|---|---|---|
| Viscosity (cP at 25° C.) | 6.55 | 9.37 | 8.10 |
| Density, kg/1 | 0.8722 | 0.8880 | 0.8752 |

TABLE 1-continued

| Properties | Palm Bio-diesel | X | Y |
|---|---|---|---|
| Energy Contents, J/g | 39539 | 37378 | 39370 |
| Pour Point, ° C. | 12.0 | 14.0 | 12.0 |
| Flash Point, ° C. | 175 | Not determined | Not determined |

TABLE 2

| | Engine Speed, rpm | | |
|---|---|---|---|
| Sample | 1500 | 2500 | 3500 |
| Palm Bio-diesel | 150.60 | 168.00 | 227.60 |
| X | 136.00 | 138.71 | 150.25 |
| Y | 146.75 | 161.3 | 196.50 |

The present disclosure includes as contained in the appended claims, as well as that of the foregoing description. Although this invention has been described in its preferred form with a degree of particularity, it is understood that the present disclosure of the preferred form has been made only by way of example and that numerous changes in the details of construction and the combination and arrangements of parts may be resorted to without departing from the scope of the invention.

The invention claimed is:

1. A fuel composition for power generation by combusting in a combustion chamber of an engine, comprising:

a water-in-oil emulsion, comprising:

(a) bio-diesel;

(b) water; and (c) at least one type of polymeric surfactant;

wherein the polymeric surfactant comprises a chemical formula of:

$$R'—O—(CH_2CH_2O—)_x—R';$$

wherein R' is an alkyl radical containing a hydroxyl group and x is a positive integer ranging from 14 to 50.

2. The fuel composition according to claim 1, wherein the bio-diesel has a concentration of 70% to 98% by total weight of the composition.

3. The fuel composition according to claim 1, wherein the water has a concentration of 2% to 30% by total weight of the composition.

4. The fuel composition according to claim 1, wherein the polymeric surfactant has a concentration of 0.1% to 5% by total weight of the composition.

5. The fuel composition according to claim 1, wherein the polymeric surfactant is a polyethylene glycol ester.

6. The fuel composition according to claim 1, wherein the polymeric surfactant is PEG1500 dihydroxystearate.

7. The fuel composition according to claim 1, further comprising an additive selected from the group consisting of corrosion inhibitors, antifreeze agents, ash modifiers, soot releasing agents and combinations thereof.

* * * * *